US007482559B2

(12) United States Patent
Cao et al.

(10) Patent No.: US 7,482,559 B2
(45) Date of Patent: Jan. 27, 2009

(54) TRANSVERSE FLUX INDUCTION HEATING APPARATUS AND COMPENSATORS

(75) Inventors: Mike Maochang Cao, Westampton, NJ (US); Vitaly A. Peysakhovich, Moorestown, NJ (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 11/693,310

(22) Filed: Mar. 29, 2007

(65) Prior Publication Data

US 2007/0235446 A1 Oct. 11, 2007

Related U.S. Application Data

(60) Provisional application No. 60/787,020, filed on Mar. 29, 2006.

(51) Int. Cl.
*H05B 6/10* (2006.01)

(52) U.S. Cl. ..... 219/645; 219/670; 219/672; 219/646; 148/576; 266/129

(58) Field of Classification Search ..... 219/645, 219/646, 635, 670, 672–677; 148/568, 567, 148/576; 266/129
See application file for complete search history.

(56) References Cited

U.S. PATENT DOCUMENTS

| | | | | |
|---|---|---|---|---|
| 3,842,234 | A * | 10/1974 | Seyfried | 219/673 |
| 4,795,872 | A * | 1/1989 | Hagisawa et al. | 219/645 |
| 2002/0121512 | A1 * | 9/2002 | Thorpe et al. | 219/645 |

* cited by examiner

*Primary Examiner*—Philip H Leung
(74) *Attorney, Agent, or Firm*—Philip O. Post

(57) ABSTRACT

An apparatus and process are provided for inductively heating a workpiece by transverse flux induction. The apparatus comprises a pair of identical coils, each of which includes a reversed head section bent to the opposite side of the workpiece. The assembled pair of coils is configured to effectively form a generally O-shaped coil arrangement on opposing sides of the workpiece. Combination electrically conductive and magnetic compensators, passive or active/passive, are also provided for use with transverse flux inductors.

7 Claims, 9 Drawing Sheets

TRANSVERSE FLUX INDUCTION HEATING APPARATUS AND COMPENSATORS

CROSS REFERENCE TO RELATED APPLICATIONS

This application claims the benefit of U.S. Provisional Application No. 60/787,020, filed Mar. 29, 2006, hereby incorporated by reference in its entirety.

FIELD OF THE INVENTION

The present invention relates to transverse flux induction heating coils and compensators, and in particular, to such apparatus when used to uniformly heat the cross section of a sheet or strip of electrically conductive material.

BACKGROUND OF THE INVENTION

A typical conventional transverse flux inductor comprises a pair of induction coils. A material to be inductively heated is placed between the pair of coils. For example, in FIG. 1, the coil pair comprises coil 101 and coil 103, respectively located above and below the material, which may be, for example, metal strip 90, which moves continuously through the pair of coils in the direction illustrated by the arrow. For orientation, a three dimension orthogonal space is defined by the X, Y and Z axes shown in FIG. 1. Accordingly the strip moves in the Z direction. The gap, $g_c$, or opening, between the coil pair is exaggerated in the figure for clarity, but is fixed in length across the cross section of the strip. Terminals 101*a* and 101*b* of coil 101, and terminals 103*a* and 103*b* of coil 103, are connected to one or more suitable ac power sources (not shown in the figures) with instantaneous current pluralities as indicated in the figure. Current flow through the coils creates a common magnetic flux, as illustrated by typical flux line 105 (illustrated by dashed line), that passes perpendicularly through the strip to induce eddy currents in the plane of the strip. Magnetic flux concentrators 117 (partially shown around coil 101 in the figure), for example, laminations or other high permeability, low reluctance materials, may be used to direct the magnetic field towards the strip. Selection of the ac current frequency (f, in Hertz) for efficient induced heating is given by the equation:

$$f = 2\times 10^6 \frac{\rho g_c}{\tau^2 d_s}$$

where ρ is the electrical resistivity measured in Ω·m; $g_c$ is the gap (opening) between the coils measured in meters; τ is the pole pitch (step) of the coils measured in meters; and $d_s$ is the thickness of the strip measured in meters.

The classical problem to be solved when heating strips by electric induction with a transverse flux inductor is to achieve a uniform cross sectional (along the X-axis), induced heating temperature across the strip. FIG. 2 illustrates a typical cross sectional strip heating profile obtained with the arrangement in FIG. 1 when the pole pitch of the coils is relatively small and, from the above equation, the frequency is correspondingly low. The X-axis in FIG. 2 represents the normalized cross sectional coordinate of the strip with the center of the strip being coordinate 0.0, and the opposing edges of the strip being coordinates +1.0 and −1.0. The Y-axis represents the normalized temperature achieved from induction heating of the strip with normalized temperature 1.0 representing the generally uniform heated temperature across middle region 111 of the strip. Nearer to the edges of the strip, in regions 113 (referred to as the shoulder regions), the cross sectional induced temperatures of the strip decrease from the normalized temperature value of 1.0, and then increase in edge regions 115 of the strip to above the normalized temperature value of 1.0.

There is a need for a transverse flux induction heating apparatus, either in the configuration of the induction coils, or compensators used with the induction coils, that will reduce induced edge overheating and increase induced heating in shoulder regions of the work piece.

BRIEF DESCRIPTION OF THE INVENTION

In one aspect, the present invention is an apparatus for, and method of, electric induction heating of an electrically conductive work piece in the form of a sheet or strip. A transverse flux induction heating apparatus comprises a pair of identical coils, each of which includes a reversed head section bent to the opposite side of the work piece. The assembled coils are configured to effectively form a generally O-shaped coil arrangement on opposing sides of the work piece that generates a magnetic field to inductively heat the work piece.

In another aspect, the present invention is an apparatus for, and method of, electric induction heating of an electrically conductive work piece in the form of a sheet or strip with a transverse flux electric inductor, wherein a combined flux compensator is used to reduce induced edge heating and increase induced shoulder region heating in the work piece, respectively.

In another aspect, the present invention is an apparatus for, and method of, electric induction heating of an electrically conductive work piece in the form of a sheet or strip with a transverse flux electric inductor, wherein a combined active and passive compensator is used. The active compensator reduces induced edge heating and the passive compensator reduces induced edge heating and increases induced shoulder region heating in the work piece.

These and other aspects of the invention are set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 3(*b*) illustrates one of the two coils comprising the transverse flux induction heating apparatus shown in FIG. 3(*a*).

FIG. 3(*c*) illustrates the effective, generally O-shaped coil, over one side of a work piece resulting from the transverse flux induction heating apparatus shown in FIG. 3(*a*).

FIG. 3(*d*) and FIG. 3(*e*) are elevation views of the transverse flux induction heating apparatus of the present invention shown in FIG. 3(*a*) through line A-A and line B-B respectively.

FIG. 4(*b*) illustrates the compensator shown in FIG. 4(*a*) with a transverse flux inductor.

FIG. 5(*b*) is an elevation view of the combined compensator shown in FIG. 5(*a*) through line C-C.

DETAILED DESCRIPTION OF THE INVENTION

Figure 1:
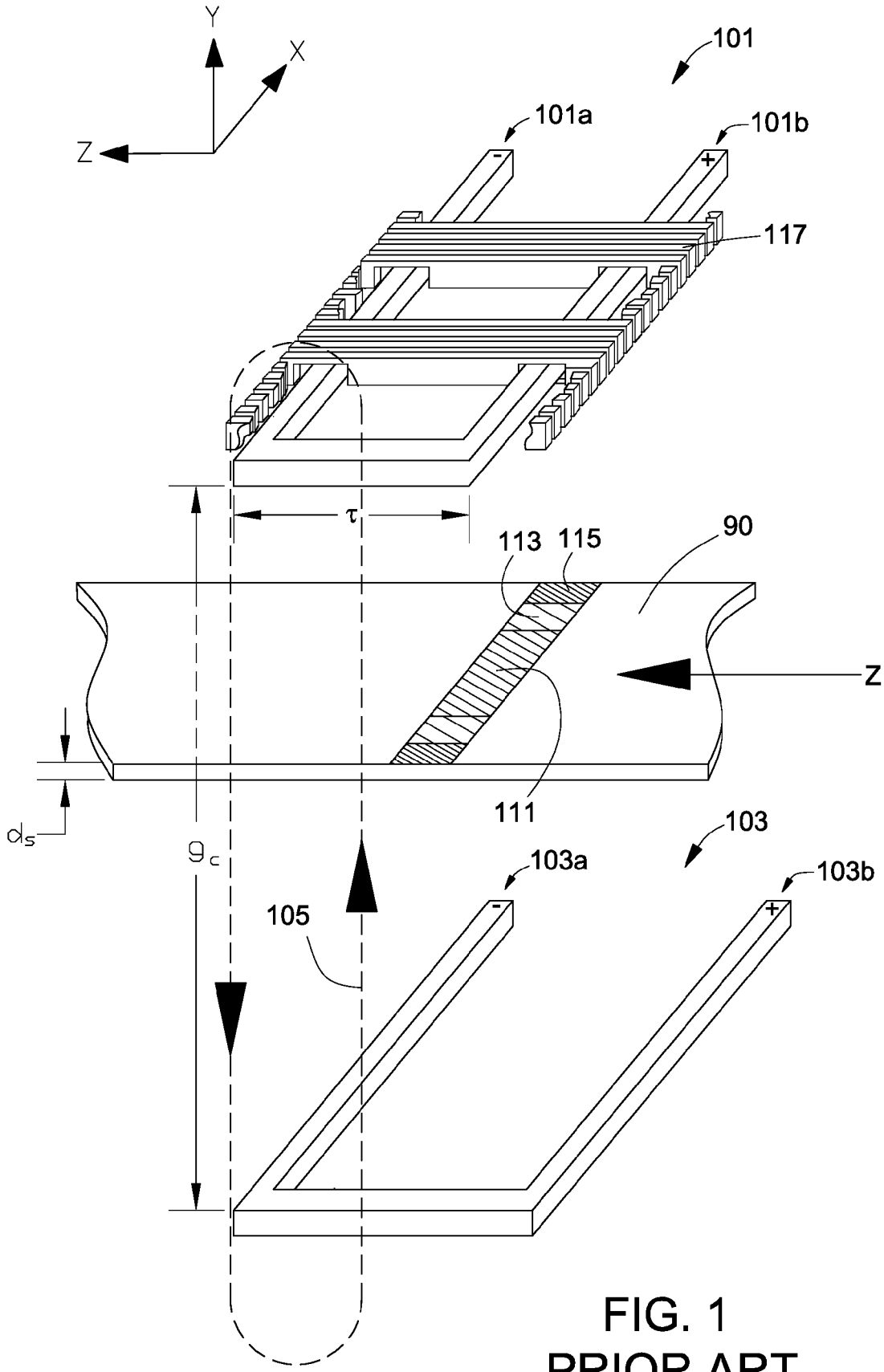
FIG. 1 PRIOR ART
FIG. 1 illustrates a prior art transverse flux inductor arrangement.

Referring now to the drawings, wherein like numerals indicate like elements, there is shown in FIG. 3(*a*) through FIG. 3(*e*) one example of a transverse induction heating apparatus 10, of the present invention. The assembled apparatus, as shown in FIG. 3(*a*), comprises first and second identical coils 12 and 14 oriented on opposing sides of electrically conductive work piece 90. The work piece may be, for example, a metal sheet or strip that passes between the coils. FIG. 3(*b*) illustrates one of the identical coils, which has a reversed (opposite) head section bent over one edge of the strip. By assembling the two coils on opposing sides of the work piece as shown in FIG. 3(*a*), an O-shaped coil effectively results on opposing sides of the work piece as illustrated in FIG. 3(*c*) for one side of the work piece, with each O-shaped coil formed from a pair of transverse coil sections and opposing head coil sections as further described below.

Referring to FIG. 3(*a*) and FIG. 3(*b*) coil 12 includes a pair of transverse sections 12*a* and 12*b* that extend cross-sectionally over the first side of the strip. Arcuate sections 12*c* and 12*d* are connected to the ends of the transverse sections as shown in the figures, and form one of the two head sections for the coil over the first side of the strip. Transverse extension sections 12*e* and 12*f* extend beyond the first edge of the strip. Riser sections 12*g* and 12*h* are connected at one end to the ends of the transverse extension sections as shown in the figures. The opposing ends of the riser sections are located adjacent to the second side of the strip and are connected to the ends of reverse transverse extension sections 12*j* and 12*k* as shown in the figures. The reverse transverse extension sections extend towards the first edge of the strip over the second side of the strip. Arcuate section 12*m* connects the ends of the reverse transverse extension sections together and forms one of the two head sections for the coil on the second side of the strip.

Coil 14 is similarly constructed of transverse sections 14*a* and 14*b*; arcuate sections 14*c* and 14*d*; transverse extension sections 14*e* and 14*f*, riser sections 14*g* and 14*h*; revere transverse extension sections 14*j* and 14*k*; and arcuate section 14*m*. In this non-limiting example the pole pitch, $\tau$, is the same for both coils 12 and 14.

FIG. 3(*d*) and FIG. 3(*e*) are side elevations further showing the orientation of coil sections at opposing edges of the strip. In some examples of the invention, the pole pitch of coils 12 and 14 can be varied by changing the angles between the pair of riser sections (12*g* and 12*h*, or 14*g* and 14*h*, respectively) of coils 12 and 14. In these examples flexible electrical connections may be provided between the pair of riser sections and connected transverse extension and reverse transverse extension sections.

AC power is suitably supplied to coils 12 and 14, for example, by suitable connections to terminals 16*a* and 16*b* for coil 12, and terminals 18*a* and 18*b* for coil 14, from one or more power supplies (not shown in the figures). Instantaneous orientation of current flows through the coils is indicated by the directional arrows associated with "1" for coil 12 and "2" for coil 14.

In the present invention, adjacent transverse extension sections, adjacent riser sections and adjacent reverse transverse extension sections are configured so that the magnetic fields created by current flows through the adjacent sections of coils 12 and 14 substantially cancel each other as diagrammatically illustrated by the current flow arrows in FIG. 3(*a*). Current flows in transverse and head coil sections on opposing sides of the strip create a common magnetic flux that passes perpendicularly through the strip and induces eddy currents in the plane of the strip to inductively heat the strip.

Coils 12 and 14 may each be integrally formed from a single piece of suitable electrical conductor such as copper. Alternatively two or more of the sections of either coil may be separately formed and joined together. Magnetic flux concentrators (not shown in the figures), for example, laminations or other high permeability, low reluctance materials, may be located around the coils to direct the magnetic field towards the strip.

In some examples of the invention, either coil 12 or 14, or both coils, may be moved (slid) in the X-direction to accommodate strips of varying widths, or to track sidewise weaving of the strip. One or more suitable mechanical operators (actuators) can be attached to either, or both, coils to accomplish movement of one or both coils.

In other examples of the invention the transverse coils may be skewed relative to the cross section (X-direction) of the work piece. In the present invention the head sections of coils 12 and 14 are generally arcuate in shape and not further limited in shape; that is, not limited for example, to semicircular shape. While coils 12 and 14 are diagrammatically illustrated here as single turn coils, in practice, the coils may be of alternative arrangements, such as but not limited to, a multi-turn coil or coils, configured either in series, parallel, or combinations thereof.

In summary, in one example of an induction coil of the present invention, a pair of transverse sections of the coil (12*a* and 12*b*, or 14*a* and 14*b*) are substantially parallel to each other and lie substantially in the same plane. A pair of arcuate sections (12*c* and 12*d*, or 14*c* and 14*d*) are connected at their first ends to adjacent first ends of the respective pair of transverse sections as shown in FIG. 3(*a*). The pair of arcuate sections lie substantially in the same plane as the pair of their respective transverse sections. A pair of transverse extension sections (12*e* and 12*f*, or 14*e* and 14*f*) are connected at their first ends to the second ends of the respective pair of arcuate sections as shown in FIG. 3(*a*), and extend away from their respective pair of transverse sections. A pair of riser sections (12*g* and 12*h*, or 14*g* and 14*h*) are connected at their first ends to the second ends of their respective pair of transverse extension sections as shown in FIG. 3(*a*), and extend away from the plane of their respective pair of transverse sections. As best seen in FIG. 3(*d*) and FIG. 3(*f*), the second ends of the respective pair of riser sections are spread further apart than the first ends of the respective riser sections to form an angle between the riser sections. A pair of reverse transverse extension sections (12*j* and 12*k*, or 14*j* and 14*k*) are connected at their first ends to the second ends of their respective pair of riser sections, and are in a plane substantially parallel to the plane of the respective pair of transverse sections and extend in the direction of their pair of transverse sections. A closing arcuate section (12*m* or 14*m*) is connected at its opposing ends to the second ends of the respective reverse transverse extension sections. An induction heating apparatus can be formed from two of the induction coils described above by orienting the second coil (14) below the first coil (12) with the closing arcuate section (14*m*) of the second coil between the pair of transverse sections (12*a* and 12*b*) of the first coil (12) in the vicinity of one edge of strip 90 that is between the first and second coils. At the opposing edge the closing arcuate section (12*m*) of the first coil is between the pair of transverse sections (14*a* and 14*b*) of the second coil as shown in FIG. 3(*a*).

Figure 2:
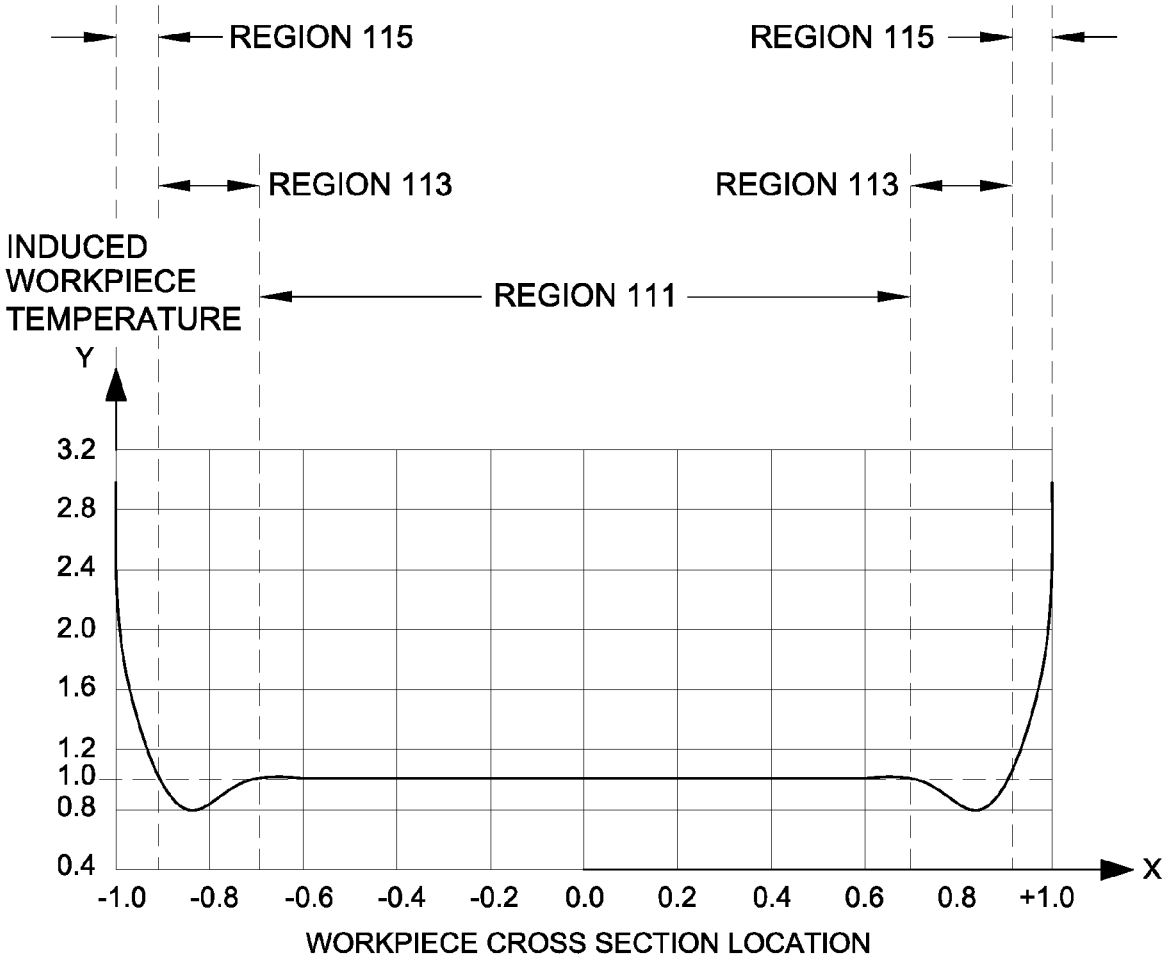
FIG. 2 graphically illustrates typical cross sectional induced heating characteristics for the transverse flux inductor arrangement shown in FIG. 1.
Figure 3A:
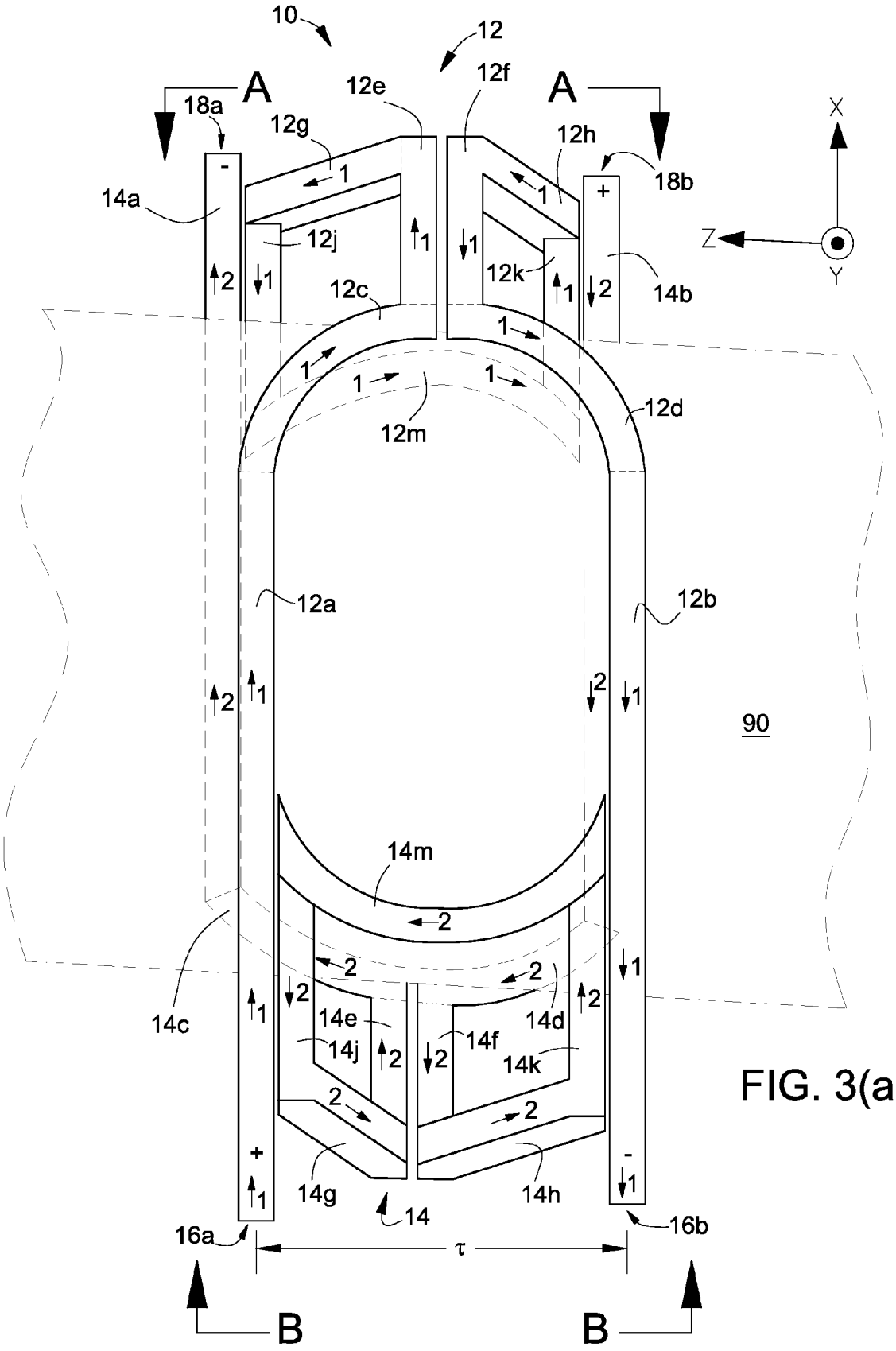
FIG. 3(*a*) illustrates one example of the transverse flux induction heating apparatus of the present invention.
Figure 3B:
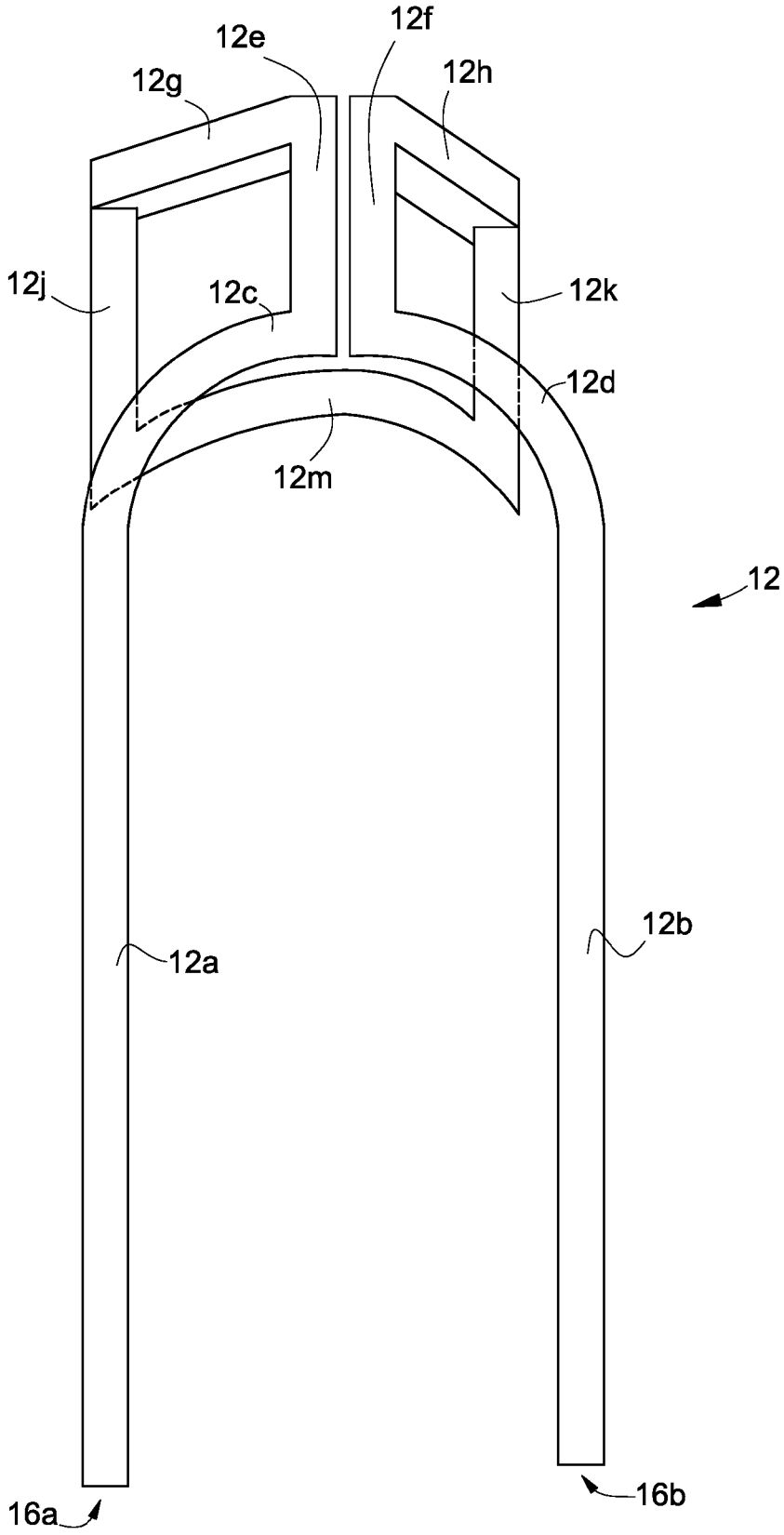
Figure 3C:
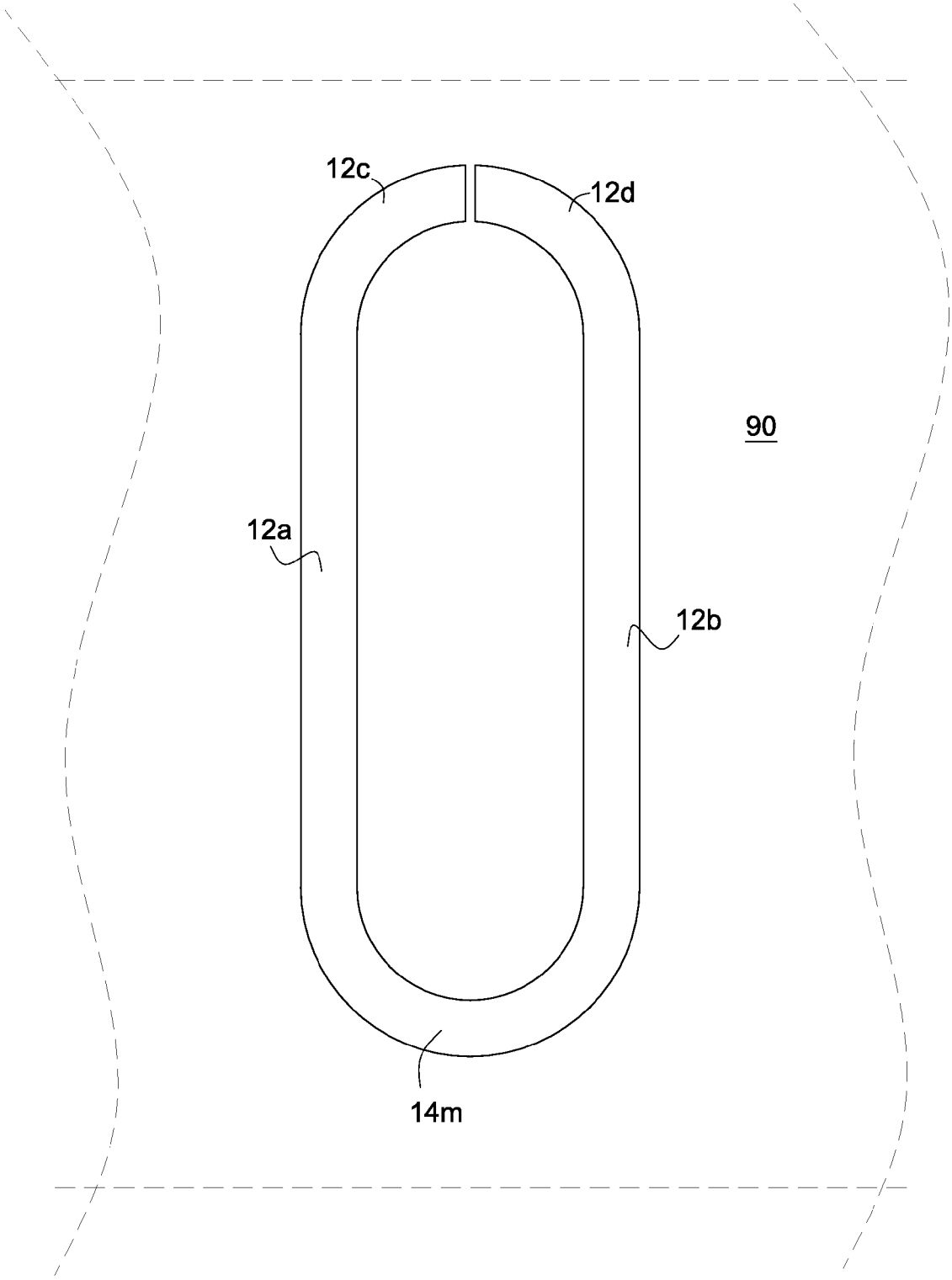
Figure 3D:
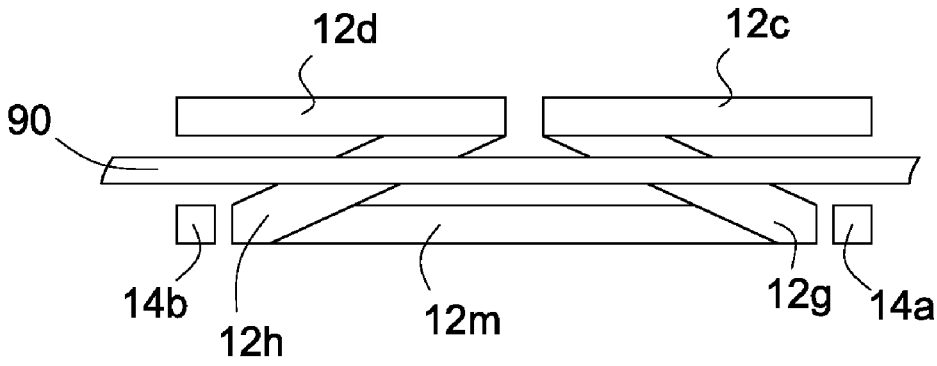
Figure 3E:
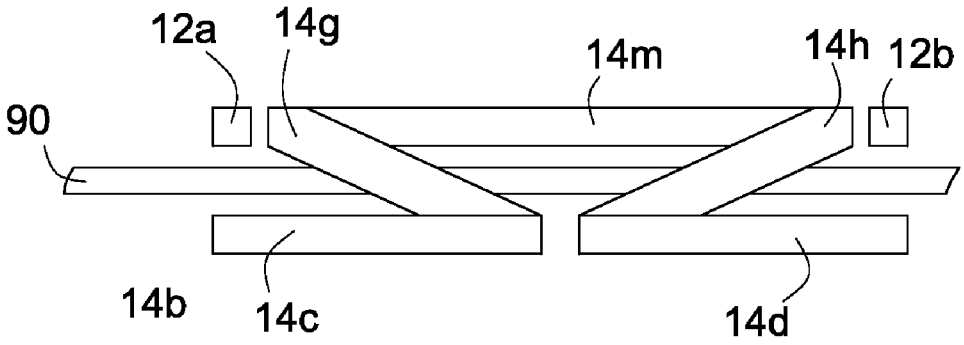
Figure 4A:
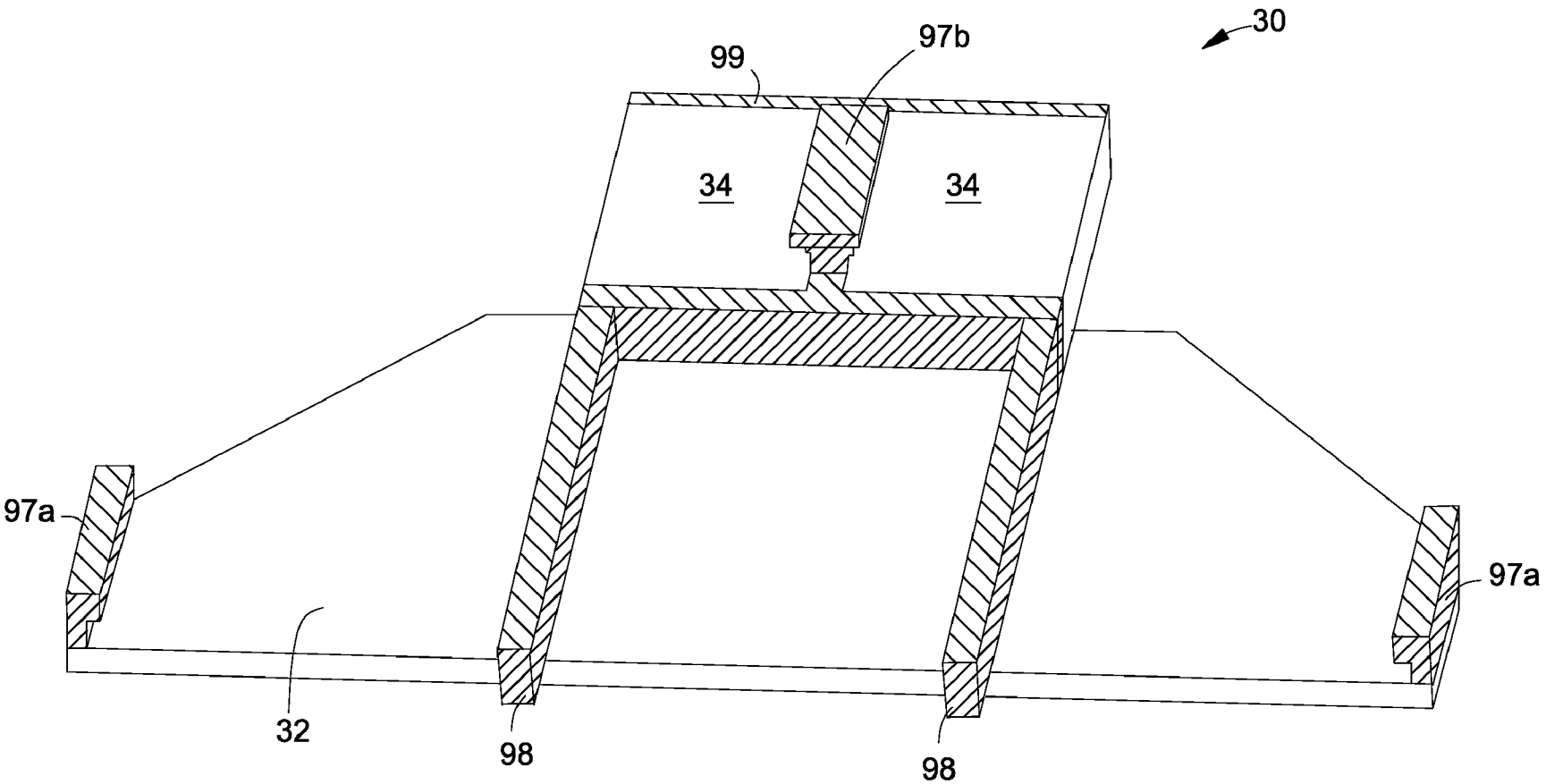
FIG. 4(*a*) illustrates one example of a combined flux compensator of the present invention.
Figure 4B:
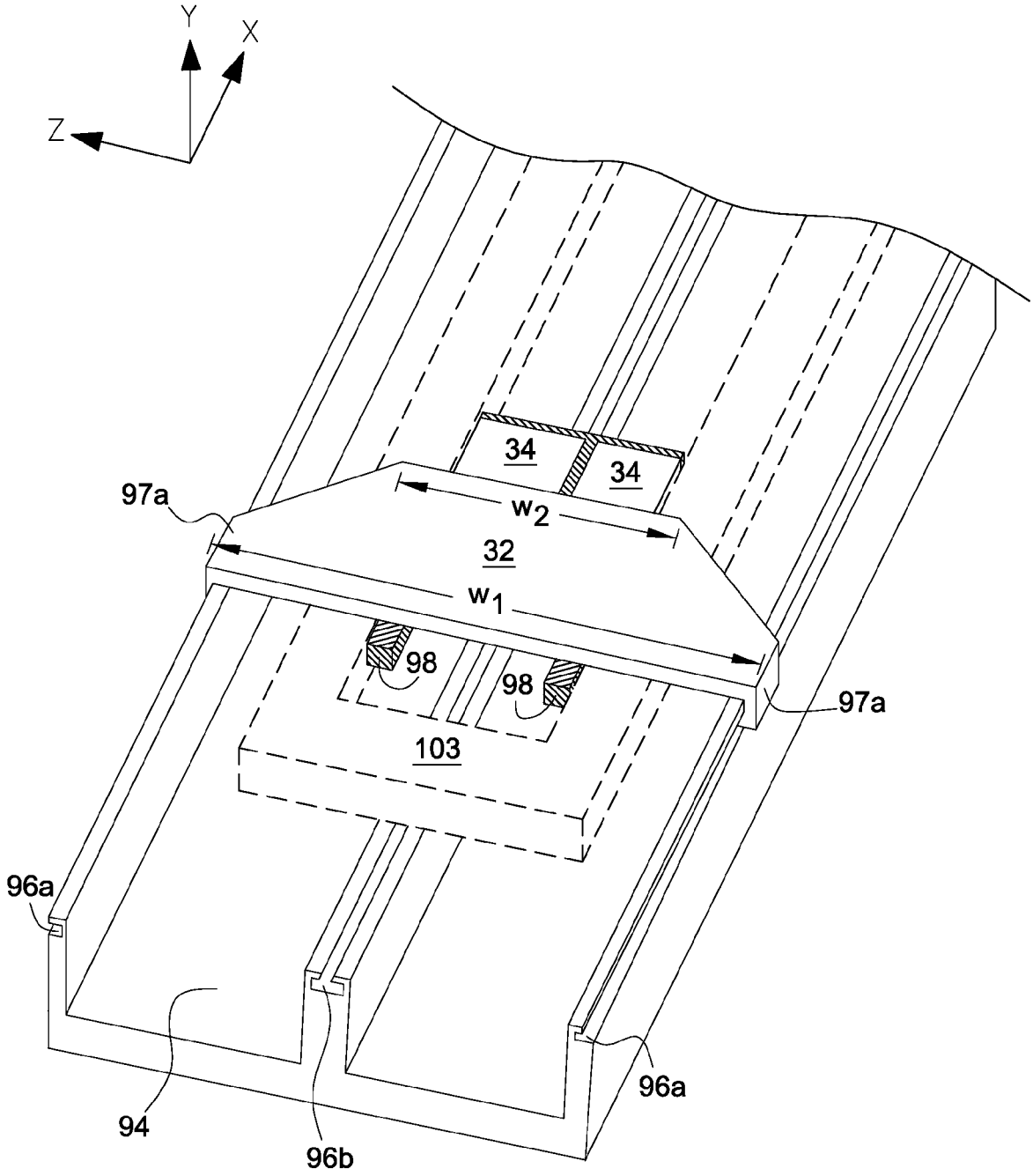

The above transverse flux induction heating apparatus is an improvement over the conventional transverse flux inductor shown in FIG. 1. Alternatively edge and shoulder region induced heating characteristics of the conventional transverse flux inductor shown in FIG. 1 may be improved by using one of the combined compensators of the present invention with a conventional transverse flux inductor. One example of a combined flux compensator of the present invention is the combined electrically conductive and magnetic (passive) compensator 30 shown in FIG. 4(*a*). Electrically conductive material 32 is used in combination with magnetic material 34 to prevent induced overheating in the edge regions and provide increased induced heating in the shoulder (knee) regions to overcome the prior art conditions illustrated in FIG. 2. Structural element 99, guide blocks 98, side and center inserts 97*a* and 97*b* in FIG. 4(*a*) represent one non-limiting method of containing the electrically conductive and magnetic materials. The electrically conductive material serves as a flux shield and the magnetic material serves as a flux concentrator. The electrically conductive material may be, for example, a planarly oriented copper plate. The magnetic material may be, for example, a planarly oriented block formed from an iron composition. The combined passive flux compensator 30 may be installed between a transverse flux induction coil and strip as shown in FIG. 4(*b*) with the transverse flux coil identified as element 103 (in dashed lines). The electrically conductive material is generally positioned over the edge region 115 of the strip (not shown in FIG. 4(*b*) for clarity; refer to FIG. 1 and FIG. 2). Generally the electrically conductive material 32 has one end with a longer width, $w_1$, closer to the head of the coil (edge region of the strip), and a second opposing end (adjacent to an edge of the magnetic material) with a shorter width, $w_2$, closer to the shoulder region of the strip, to provide adequate shielding around the head of the coil. The magnetic material is generally positioned over the shoulder region 113 of the strip (not shown in FIG. 4(*b*) for clarity; refer to FIG. 1 and FIG. 2). Further as shown FIG. 4(*b*) the combined passive flux compensator may be moveable mounted along the transverse of the coil (X-direction) so that the compensator can be moved to optimize compensation as the width of the strip changes, or a strip sways sidewise as it passes through a pair of coils making up the transverse flux inductor. One method of moving the compensator is shown in FIG. 4(*b*). In this non-limiting arrangement, coil 103 is situated in enclosure 94, which includes insert side grooves 96*a* and insert center groove 96*b*. Side inserts 97*a* and center insert 97*b* are attached to the combined concentrator as shown in the figures and are inserted into side grooves and center groove, respectively, to allow the combined concentrator to slide in the transverse direction of the coil. Guide blocks 98 may be provided to assist in keeping the combined flux concentrator in transverse alignment with the coil. Structural element 99 can provide a housing for the magnetic material and method of attaching the magnetic material to the electrically conductive material.

Figure 5A:
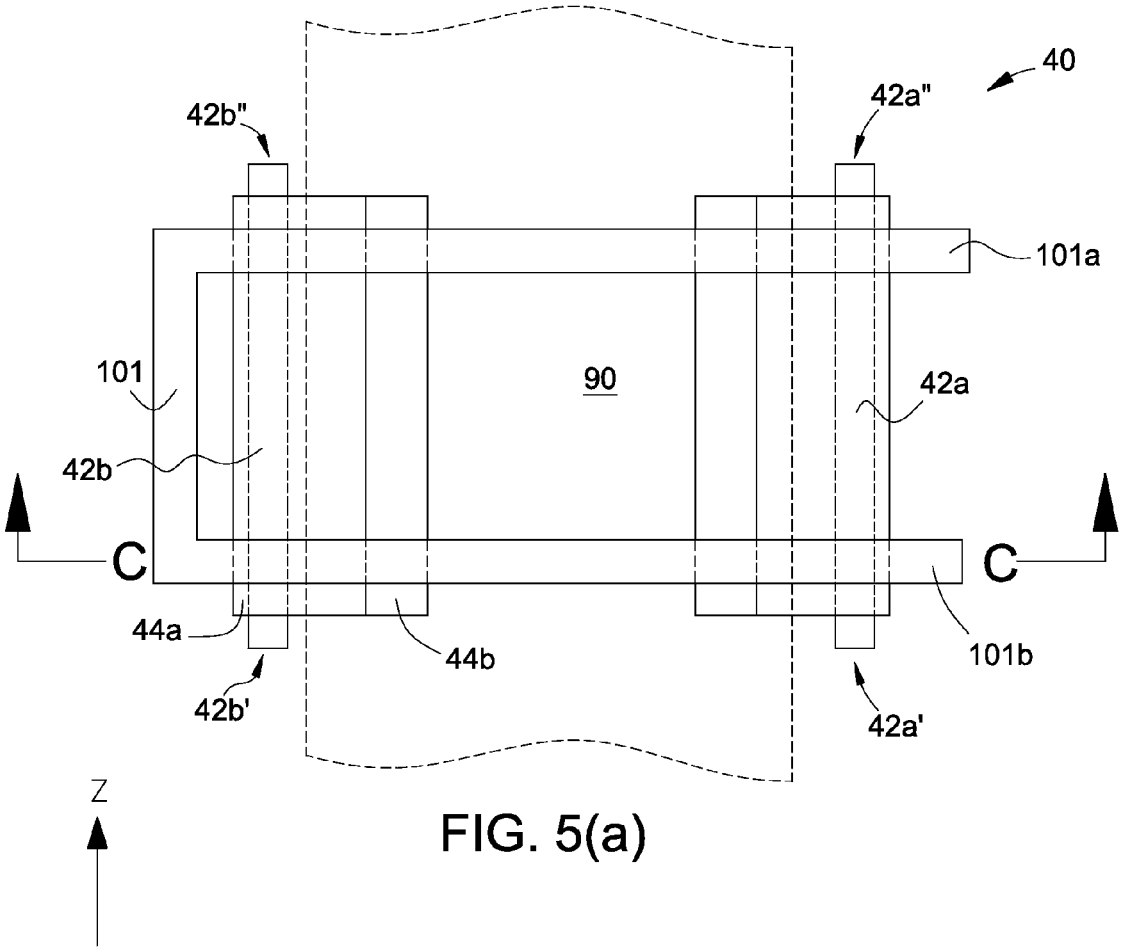
FIG. 5(*a*) illustrates in top planar view one example of a combined active and passive compensator of the present invention.
Figure 5B:
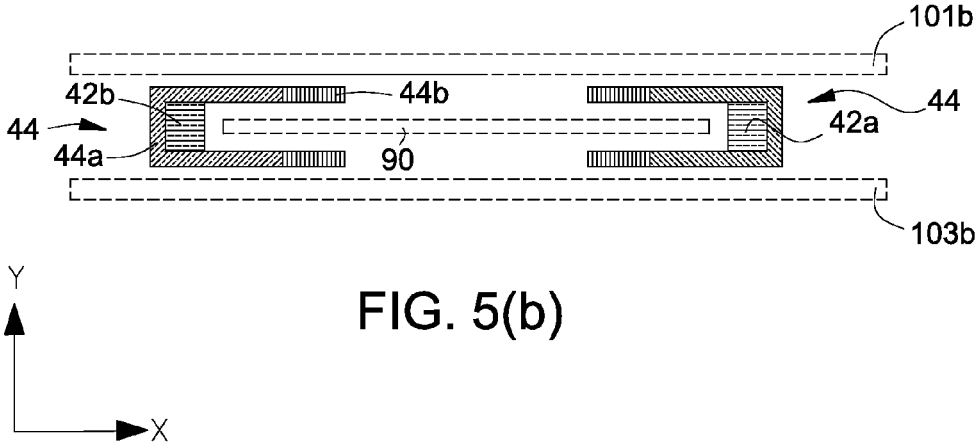

FIG. 5(*a*) and FIG. 5(*b*) illustrate one example of a combined active and passive compensator 40 of the present invention, which can be used with the transverse flux induction coils 101 and 103 shown in FIG. 1, with strip 90 located between the coils. The active compensator in this non-limiting example comprises the pair of electrical conductors 42*a* and 42*b*, which are located adjacent to the opposing edges of the strip. Each conductor is connected to an ac power source operating at the same frequency as the one or more power supplies providing ac power to coils 101 and 103, or to the same power supplies. Power connections may be made, for example, at terminals 42*a*' and 42*a*" for coil 42*a*, and at terminals 42*b*' and 42*b*" for coil 42*b*. The magnetic fields created around conductors 42*a* and 42*b* push currents induced in the strip (from the magnetic fields created by current flow in coils 101 and 103) away from the edges of the strip to reduce the previously described edge overheating. The passive compensator in this non-limiting example comprises two U-shaped passive compensators 44. A U-shaped passive compensator is located between coils 101 and 103, and around each edge of the strip as shown in FIG. 5(*a*) and FIG. 5(*b*). Each U-shaped passive compensator 44 comprises electrically conductive (e.g. copper) element 44*a* in combination with magnetic element 44*b* (e.g. iron laminations) connected to the legs of the U-shaped electrically conductive element as shown in the figures. In this non-limiting example of the invention, the base and upper leg segments of the U-shaped passive compensator 44 comprise the electrically conductive element 44*a*, and the lower legs of the U-shaped passive compensator comprises magnetic element 44*b*. The electrically conductive element, located around the edge of the strip, decreases induced heating in the edge regions of the strip; and the magnetic element, located approximately above and below the shoulder regions of the strip, increases induced heating in the shoulder regions of the strip. In this non-limiting example, U-shaped passive compensators 44 are fitted around conductors 42*a* and 42*b* as shown in the figures. Combined active and passive compensator 40 may be connected to suitable mechanical operators (actuators) that move the compensator towards or away from the edge of the strip (in the X-direction) as the width of a strip changes, or a strip sways sidewise as it passes between the coils.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto, and changes may be made without departing from the scope of the invention in its aspects.

The invention claimed is:

1. A combined flux compensator comprising:

a planarly oriented electrically conductive material having a first end and a second end opposing the first end, the first end being shorter in length than the length of the second end; and a planarly oriented magnetic material located adjacent to the first end of the planarly oriented electrically conductive material, the planarly oriented magnetic material at least partially coplanar with the planarly oriented electrically conductive material.

2. A method of controlling the magnetic flux generating around the head region of a transverse flux induction coil, the method comprising the steps of:

forming a combined flux compensator from a planarly oriented electrically conductive material having a first end and a second end opposing the first end, the first end being shorter in length than the length of the second end, and a planarly oriented magnetic material located adjacent to the first end of the planarly oriented electrically conductive material, the planarly oriented magnetic material at least partially coplanar with the planarly oriented electrically conductive material;

locating the planarly oriented electrically conductive material of the combined flux compensator between the edge region of a strip and the head region of the transverse flux induction coil; and locating the planarly oriented magnetic material of the combined flux compensator between the shoulder region of the strip and the head region of the transverse flux induction coil.

3. The method of claim 2 further comprising the step of sliding the combined flux compensator along the transverse of the transverse flux induction coil to compensate for movement of the edge and shoulder sections of the strip.

4. The method of claim 2 further comprising the step of placing the combined flux compensator in a frame.

5. A combined active and passive compensator for induction heating of a strip between a pair of transverse induction coils connected to at least one induction heating power supply, the combined active and passive compensator comprising:

a pair of electrical conductors, each of the pair of electrical conductors disposed adjacent to the opposing edges of the strip, the pair of electrical conductors connected to a power supply operating substantially at the same frequency of the at least one induction heating power supply; and a U-shaped compensator extending around each one of the electrical conductors, the base and upper legs of the U-shaped compensator formed from an electrically conductive material and the lower legs of the U-shaped compensator formed from a magnetic material.

6. The combined active and passive compensator of claim 5 further comprising an operator for moving the combined active and passive compensator towards or away from the edges of the strip.

7. A method of inductively heating a strip comprising the steps of:

passing the strip between a pair of transverse induction coils connected to at least one induction heating power supply; and locating adjacent to each opposing edge of the strip an electrical conductor connected to a power supply operating substantially at the same frequency of the at least one induction heating power supply, a U-shaped compensator extending around each one of the electrical conductors, the base and upper legs of each separate U-shaped compensator formed from an electrically conductive material and the lower legs of the U-shaped compensator formed from a magnetic material.

* * * * *